US010961781B2

(12) United States Patent
Khandekar et al.

(10) Patent No.: US 10,961,781 B2
(45) Date of Patent: Mar. 30, 2021

(54) ANTI-ROTATION PADS WITH FLOW PORTS

(71) Applicant: HALLIBURTON ENERGY SERVICES, INC., Houston, TX (US)

(72) Inventors: Akshay G. Khandekar, Houston, TX (US); Hartley Randle, Spruce Grove (CA); Hasib Uddin, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 18 days.

(21) Appl. No.: 16/341,865

(22) PCT Filed: Nov. 4, 2016

(86) PCT No.: PCT/US2016/060712
§ 371 (c)(1),
(2) Date: Apr. 12, 2019

(87) PCT Pub. No.: WO2018/084861
PCT Pub. Date: May 11, 2018

(65) Prior Publication Data

US 2019/0242188 A1 Aug. 8, 2019

(51) Int. Cl.
*E21B 17/10* (2006.01)
*E21B 7/06* (2006.01)
(Continued)

(52) U.S. Cl.
CPC ..... *E21B 7/062* (2013.01); *E21B 10/20* (2013.01); *E21B 10/325* (2013.01);
(Continued)

(58) Field of Classification Search
CPC .... E21B 17/1014; E21B 7/062; E21B 10/325; E21B 10/20; E21B 21/103; E21B 17/1057; E21B 47/024
See application file for complete search history.

(56) References Cited

U.S. PATENT DOCUMENTS

2002/0185314 A1 12/2002 Cargill et al.
2005/0098353 A1* 5/2005 Maxwell ..... E21B 17/1014 175/57
(Continued)

FOREIGN PATENT DOCUMENTS

WO WO-9840601 A1 9/1998

OTHER PUBLICATIONS

Korean Intellectual Property Office, International Search Report and Written Opinion, PCT/US2016/060712, dated Jul. 24, 2017.

*Primary Examiner* — Brad Harcourt

(57) ABSTRACT

Anti-rotation pad assemblies are provided for restraining rotation of a non-rotating housing in geologic drilling system. The anti-rotation pad assemblies include extensible members, which extend from an internal cavity in the anti-rotation pad assemblies and are capable of engaging a wellbore wall. The extensible members may include rollers that are biased radially outwardly to engage the wellbore wall such that the anti-rotation pad assemblies may move axially within the wellbore while restraining the non-rotating housing in a particular rotational orientation. Flow ports are defined in the anti-rotation pad assemblies to encourage mud flow through the internal cavity, and thereby discourage the accumulation and solidification of drilling fluids around the extensible members. The extensible members thus remain free to move under the bias of a biasing mechanism within the internal cavity and can thus effectively maintain the rotational orientation of the non-rotating housing in the wellbore.

20 Claims, 8 Drawing Sheets

(51) Int. Cl.

| | |
|---|---|
| ***E21B 10/32*** | (2006.01) |
| ***E21B 10/20*** | (2006.01) |
| ***E21B 21/10*** | (2006.01) |
| *E21B 47/024* | (2006.01) |

(52) U.S. Cl.
CPC ..... *E21B 17/1014* (2013.01); *E21B 17/1057* (2013.01); *E21B 21/103* (2013.01); *E21B 47/024* (2013.01)

(56) References Cited

U.S. PATENT DOCUMENTS

| | | | | |
|---|---|---|---|---|
| 2007/0251726 | A1 | 11/2007 | Menger | |
| 2012/0031609 | A1 | 2/2012 | Wheater et al. | |
| 2013/0118812 | A1 | 5/2013 | Clausen et al. | |
| 2015/0047829 | A1* | 2/2015 | Millet | E21B 43/126 166/214 |
| 2015/0152723 | A1* | 6/2015 | Hay | E21B 10/62 175/17 |

* cited by examiner

ANTI-ROTATION PADS WITH FLOW PORTS

CROSS-REFERENCE TO RELATED APPLICATIONS

This application is a U.S. national stage patent application of International Patent Application No. PCT/US2016/060712, filed on Nov. 4, 2016, the benefit of which is claimed and the disclosure of which is incorporated herein by reference in its entirety.

BACKGROUND

The present disclosure relates generally to drilling systems that include a non-rotating housing, e.g., drilling systems employed for directionally drilling wellbores in oil and gas exploration and production. More particularly, embodiments of the disclosure relate to anti-rotation pad assemblies for restraining rotation of the non-rotation housing with respect a borehole wall during operation of the drilling system.

Directional drilling is one example of a drilling operation that may employ a non-rotating housing. Directional drilling operations involve controlling the direction of a wellbore as it is being drilled. The direction of a wellbore refers to both its inclination relative to vertical, and its azimuth or angle from true north or magnetic north. Usually the goal of directional drilling is to reach a target subterranean destination with a drill string.

Some directional drilling techniques involve rotating a drill bit with a positive displacement motor (mud motor) and a bent housing included in the bottom hole assembly (BHA). The BHA can be connected to a drill string or drill pipe extending from a surface location, and the mud motor can be powered by circulation of a drilling fluid or "mud" supplied through the drill string. The BHA can be steered by sliding, e.g., operating the mud motor to rotate the drill bit without rotating the non-rotating, bent housing in the BHA. With the bend in the bent housing oriented in a specific direction, continued drilling causes a change in the wellbore direction. Other directional drilling techniques include the use of a Rotary Steerable System (RSS) in a BHA. Generally, an RSS changes direction either by pushing against one side of a wellbore wall to thereby cause the drill bit to push on the opposite side, or by bending a main shaft running through a non-rotating housing to point the drill bit in a particular direction with respect to the rest of the tool. Thus, a non-rotating housing may be employed in directional drilling whether a mud motor or an RSS is used.

One or more anti-rotation pad assemblies may be provided around the non-rotating housing for restraining rotation of the non-rotating housing. The anti-rotation pad assemblies may include one or more extensible members, such as rollers, that are capable of protruding radially from a cavity in the anti-rotation pad assembly to engage the borehole wall to perform the restraining or anti-rotation function. Mud cake build-up, the accumulation of sediments and/or solidification of drilling fluids in the cavity may inhibit the ability of extensible members to protrude from the cavity, and thus inhibit the ability of the non-rotating housing to restrain its rotation.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes anti-rotation pad assemblies for restraining rotation of a non-rotating housing. The anti-rotation pad assemblies include extensible members, which extend from an internal cavity in the anti-rotation pad assemblies and are capable of engaging a wellbore wall. The extensible members may include rollers that are biased radially outwardly to engage the wellbore wall such that the anti-rotation pad assemblies may move axially within the wellbore while restraining the non-rotating housing in a particular rotational orientation. Flow ports are defined in the anti-rotation pad assemblies to encourage mud flow through the internal cavity, and thereby discourage the accumulation and solidification of drilling fluids around the extensible members. The extensible members thus remain free to move under the bias of a biasing mechanism within the internal cavity and can thus effectively maintain the rotational orientation of the non-rotating housing in the wellbore.

Figure 1:
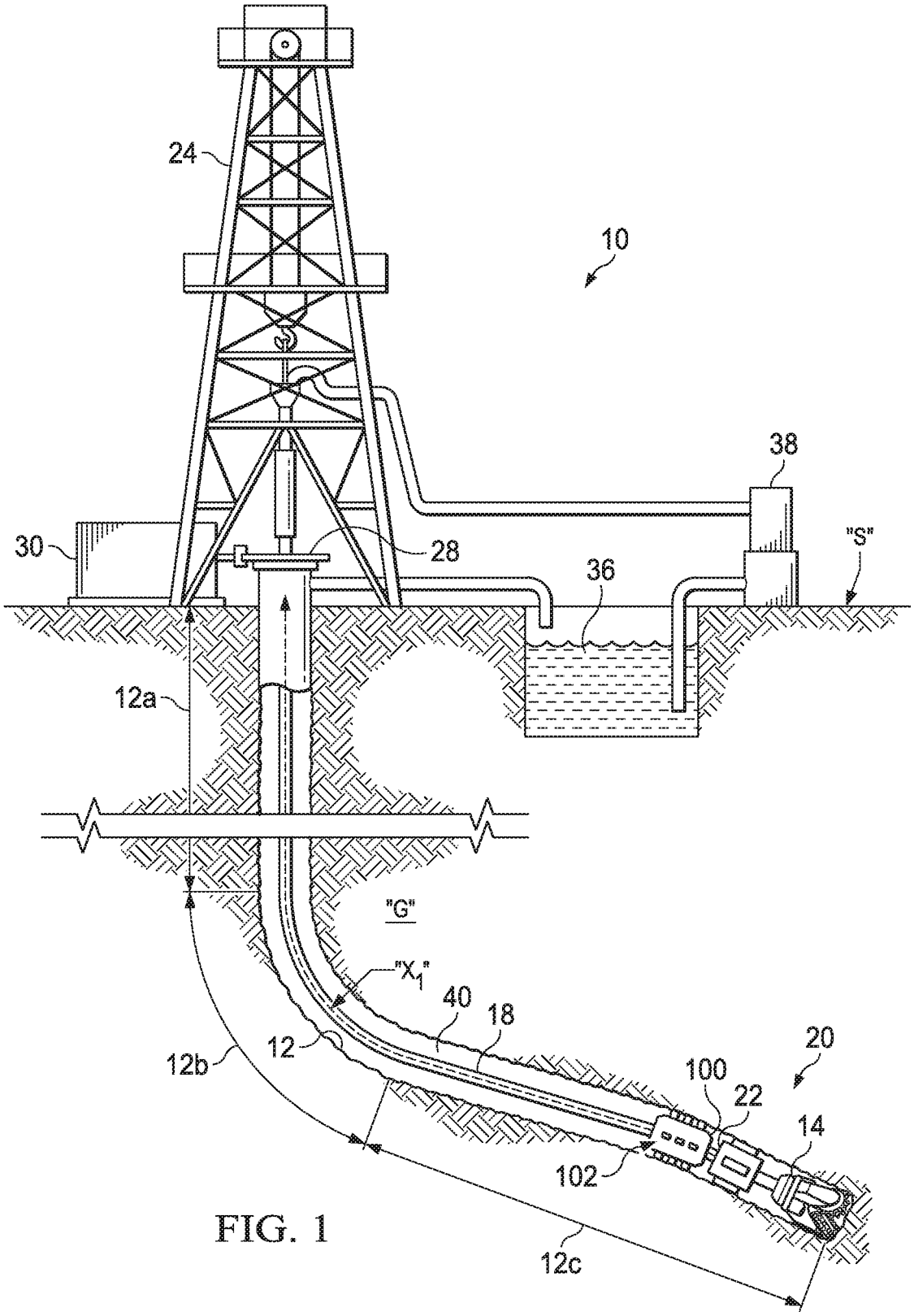
FIG. 1 is a partial cross-sectional side view of a directional wellbore drilled with a drilling system with a non-rotating housing having plurality of anti-rotation pad assemblies.

FIG. 1 is a partially cross-sectional side view of a terrestrial a drilling system 10 for drilling a directional wellbore 12 in accordance with example embodiments of the disclosure. The drilling system 10 includes a non-rotating housing 100 having plurality of anti-rotation pad assemblies 102 circumferentially spaced around the non-rotating housing 100. Although a terrestrial drilling 10 is illustrated, it will be appreciated that aspects of the disclosure may also be practiced in an offshore drilling system without departing from the scope of the disclosure. The wellbore 12 extends from a surface location "S" through a geologic formation "G" along a curved longitudinal axis $X_1$ to define a vertical section 12*a*, a build section 12*b* and a tangent section 12*c*.

The tangent section 12*c* is the deepest section of the wellbore 12, and may exhibits lower build rates (changes in the inclination of the wellbore 12) than the build section 12*b*.

A rotary drill bit 14 is provided at a down-hole location in the wellbore 12 (illustrated in the tangent section 12*c*) for cutting into the geologic formation "G." A drill string 18 extends between the drill bit 14 and the surface location "S," and in some exemplary embodiments, a bottom hole assembly (BHA) 20 is provided within the drill string 18 proximate the drill bit 14. The BHA 20 can be operable to rotate the drill bit 14 with respect to the drill string 18. The term "bottom hole assembly" or "BHA" may be used in this disclosure to describe various components and assemblies disposed proximate to the drill bit 14 at the down-hole end of drill string 18. Examples of components and assemblies (not expressly illustrated in FIG. 1) which may be included in the BHA 20 include, but are not limited to, the non-rotating housing 100, a bent sub or housing, a mud motor, a rotary steerable system, a near bit stabilizer 22, and other down hole instruments. The non-rotating housing 100 may contain a variety of well logging tools (not expressly shown), inclination sensors and other down-hole instruments associated with directional drilling of a wellbore 12. Some of these instruments may detect or rely on a particular tool face of the drilling system 10. In the event that the non-rotating housing 100 rotates within the wellbore, the ability of these instruments to detect the tool face and control a direction of drilling may be compromised.

At a surface location "S" a drilling rig 22 is provided to facilitate drilling of the wellbore 12. The drilling rig 24 includes a turntable 28 that may rotate the drill string 18 and the drill bit 14 together about the longitudinal axis $X_1$. The turntable 28 is selectively driven by an engine 30, and can be locked to prohibit rotation of the drill string 18, e.g., when a mud motor (not expressly, illustrated) is employed to rotate the drill bit 14 with respect to the drill string 18. Whether the turntable 28, a mud motor or an RSS rotates the drill bit 14, mud 36 can be circulated down-hole by mud pump 38. The mud 36 is pumped through the drill string 18 and passed through the BHA 20. The mud 36 can be expelled through openings (not shown) in the drill bit 14 to lubricate the drill bit 14, and then returned to the surface location through an annulus 40 defined between the drill string and the geologic formation "G."

As the mud 36 returns through the annulus, the mud 36 encounters the non-rotating housing 100. As described in greater detail below, the anti-rotation pad assemblies 102 on the non-rotating housing 100 include flow passages therein to encourage flow of the mud 36 through the areas that are prone to mud settling. The anti-rotation pad assemblies 102 may thus remain functional to maintain engagement with the geologic formation "G" and maintain a particular rotational orientation of the non-rotating housing 100 in the wellbore 12.

Figure 2:
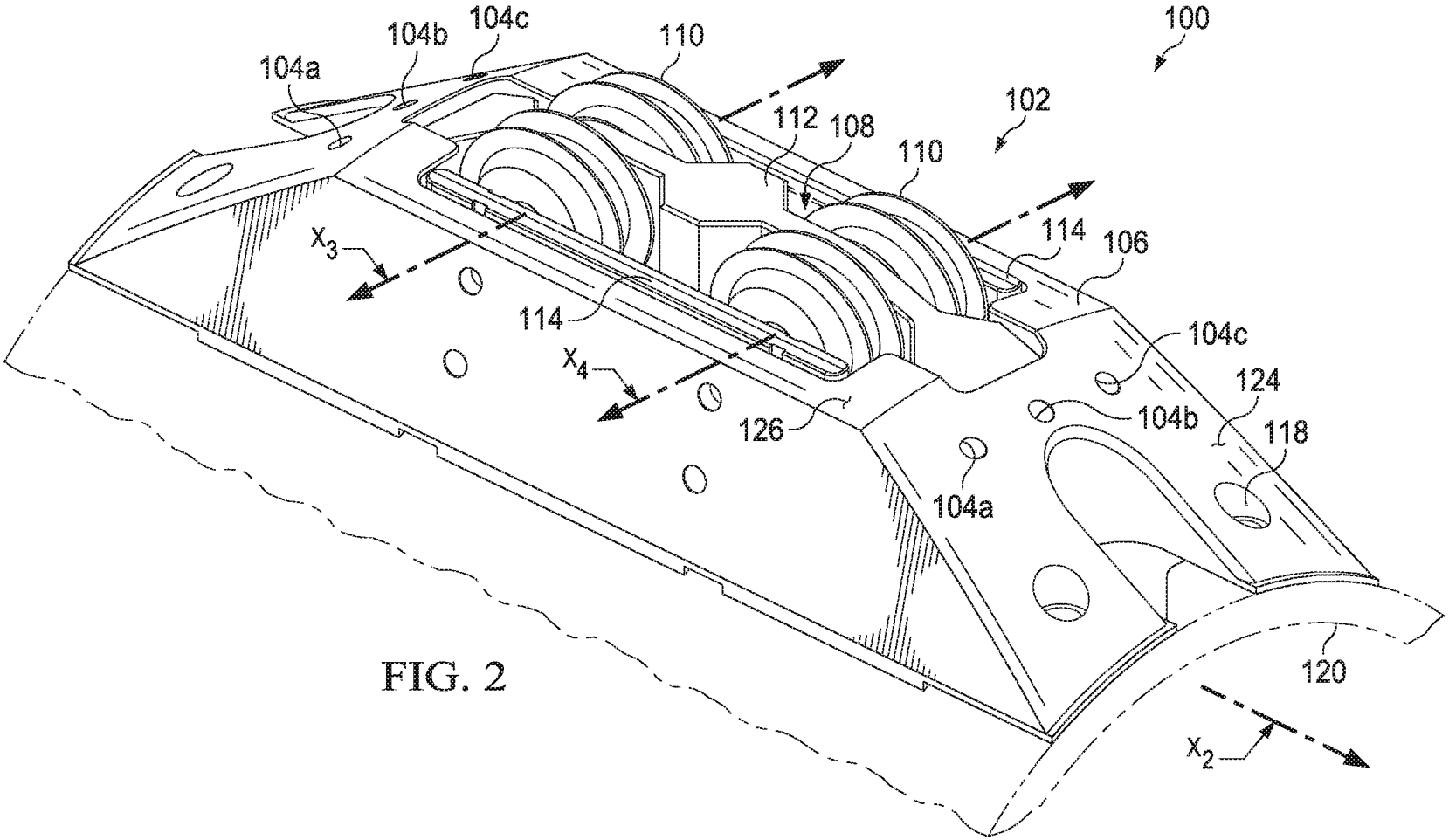
FIG. 2 is a perspective view of an anti-rotation pad assembly of FIG. 1 illustrating a plurality of flow ports defined between an exterior and an interior cavity of the anti-rotation pad assembly, the interior cavity containing a plurality of extensible members, a carriage plate supporting the extensible members and a pair of wear plates.

FIG. 2 is a perspective view of one of the anti-rotation pad assemblies 102 of the non-rotating housing 100. The anti-rotation pad assembly 102 includes a plurality of flow ports 104*a*, 104*b*, 104*c* (collectively or generally flow ports 104) defined in an outer housing 106 between an exterior of the anti-rotation pad assembly 102 and an interior cavity 108 of the anti-rotation pad assembly 102. The interior cavity 108 contains a plurality of extensible members 110, a carriage plate 112 supporting the extensible members 110 and a pair of wear plates 114 disposed on lateral sides of the carriage plate 112.

The outer housing 106 includes a plurality of radial bores 118, through which a fastener (not shown) may extend to facilitate coupling the anti-rotation pad assembly 102 to a tubular member 120 of the non-rotating housing 100. In some embodiments, three anti-rotation pad assemblies 102 may be spaced at substantially equal intervals, e.g., 120 degree intervals, about the tubular member 120. The extensible members 110 may be biased to protrude radially from the interior cavity 108 to contact the wall of the wellbore 12 (FIG. 1) to slow or inhibit the turning of the non-rotating housing 100 about a longitudinal axis "$X_2$" of the tubular member 120. As illustrated, the extensible members 110 are roller members arranged to exert a load on the wall of the wellbore 12 and roll about an axis, e.g. axis "$X_3$" or "$X_4$," that is substantially normal to the longitudinal axis "$X_2$" of the tubular member 120. As a result, axial motion of the non-rotating housing 100 in the direction of longitudinal axis "$X_2$" is relatively undisturbed as the rotational motion about the longitudinal axis "$X_2$" is restrained. Thus, the non-rotating housing 100 is permitted to roll through the wellbore 12 in a desired rotational orientation.

The flow ports 104 extend between the interior cavity 108 and leading and trailing inclined surfaces 124 on the exterior of outer housing 106. The flow ports 104 define flow port openings on the exterior inclined surfaces 124 of the outer housing 106. The flow port openings are spaced from a primary opening defined in a longitudinal, radially outermost surface 126 by the internal cavity 108. The inclined surfaces 124 extend generally both longitudinally and radially between the tubular member 120 and theradially outermost surface 126 of the outer housing 106. The inclined surfaces 124 are oriented generally in the direction of mud flow, e.g., generally at leading and trailing ends of anti-rotation pad assembly 102.

Figure 3:
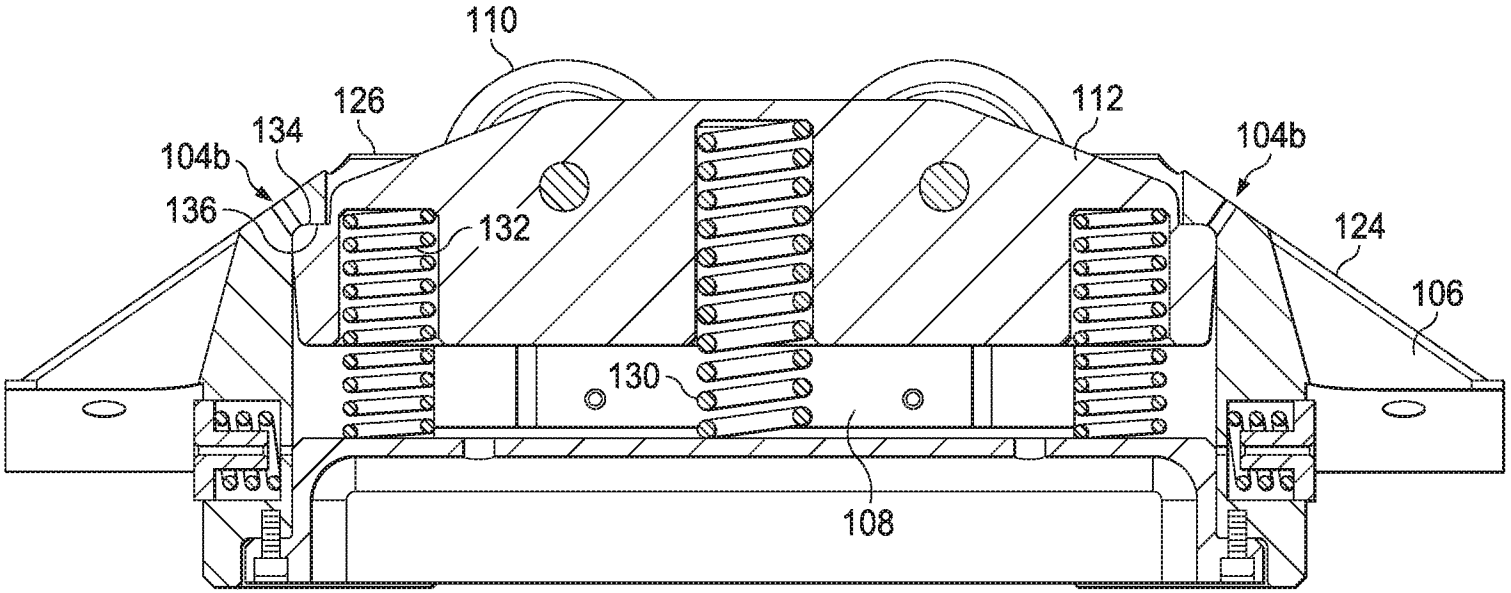
FIG. 3 is a cross-sectional side view of the anti-rotation pad assembly of FIG. 2 illustrating the extensible members and the carriage plate biased to a fully extended position.

FIG. 3 is a cross-sectional side view of the anti-rotation pad assembly 102 illustrating the extensible members 110 and the carriage plate 112 biased to a fully extended position. A plurality of biasing mechanisms 130, 132 are provided for urging the carriage plate 112 radially outward. The extensible members 110 are rotatably supported on the carriage plate 112, e.g., about axes "$X_3$" and "$X_4$," and thus, the extensible members 110 are also biased radially outward to impart a force on the geologic formation "G" (FIG. 1). Any method, mechanism, structure or device may be used for biasing the carriage plate 112 and extensible members 110 to the extended position. As illustrated, the biasing mechanisms 130, 132 are compression springs selected such that the force imparted to the geologic formation is sufficient to inhibit rotation of the non-rotating housing 100 (FIG. 1), but not so great that the extensible members 110 damage casing member (not show) or other tubulars disposed in the wellbore 12 (FIG. 1). Any number of extensible members 110 may be provided to distribute the load force provided the biasing mechanisms 130, 132 to the wellbore wall.

The carriage plate 112 is illustrated in a fully extended position where a radially outward facing shoulder 134 of the carriage plate 112 engages a radially inward facing shoulder 136 of the outer housing 106. Engagement of the shoulders 134, 136 retains the carriage plate 112 within the interior cavity 108 and permits the extensible members 110 to protrude radially beyond the radially outermost surface 126 of the outer housing 106. Where sediments in the mud 36 (FIG. 1) or other drilling fluid is deposited on the shoulders 134, 136, the deposited mud 36 may cause and maintain a separation of the shoulders 134, 136. Thus the carriage plate 112 and extensible members 110 may not extend radially from the interior cavity 108 to the extent necessary to cause the extensible members 110 to effectively engage the geologic formation "G."

A central flow port 104*b* on each of the leading and trailing ends of the anti-rotation pad assembly 102 is arranged on a trajectory that intersects the shoulders 134, 136. Thus fluid flowing through the central flow port may be encouraged to flow past the shoulders 134, 136 as the fluid flows into and/or out of the interior cavity 108. The flow of fluid over the shoulders 134, 136 may discourage accumulation of sediments between the shoulders 134, 136 that could cause sticking of the extensible members 110 within the interior cavity 108.

Figure 4:
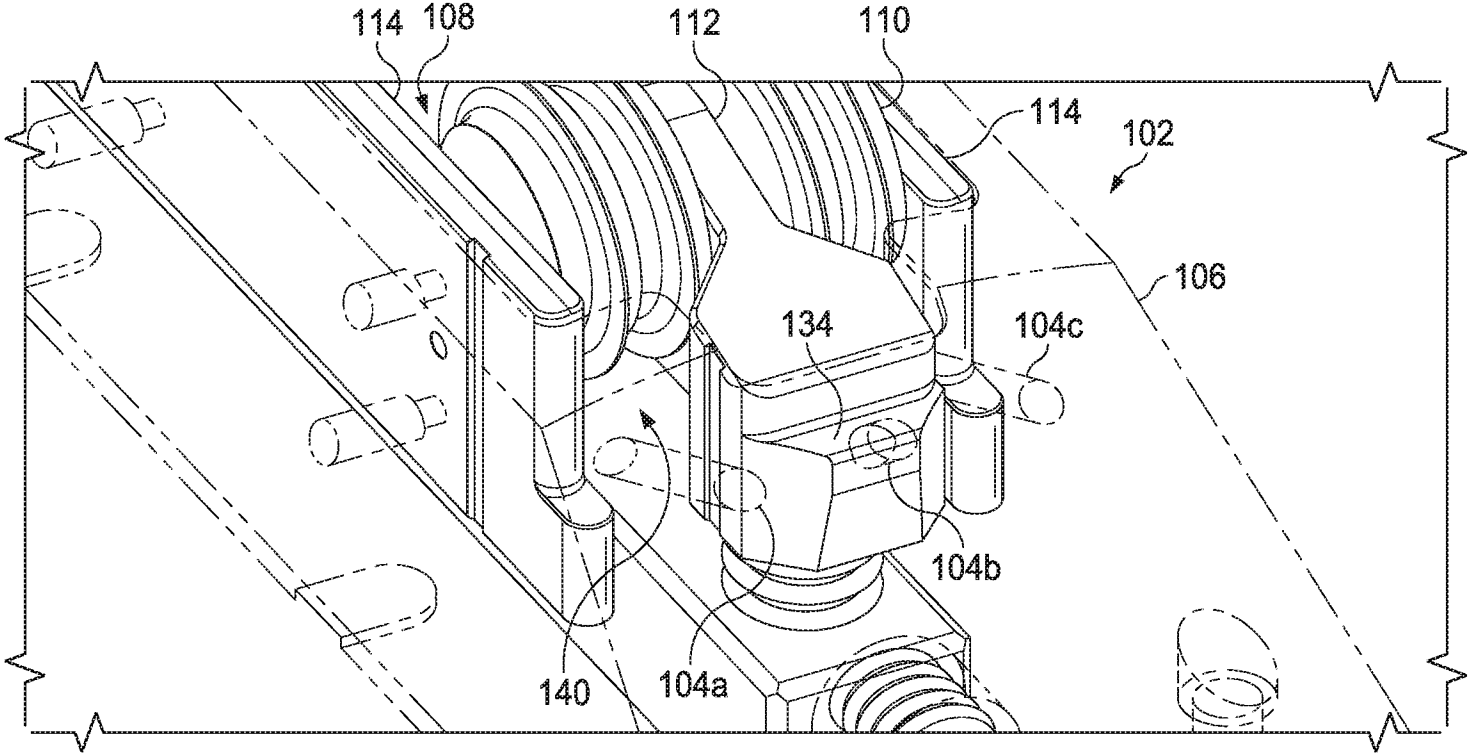
FIG. 4 is a partial perspective view of the anti-rotation pad assembly of FIG. 2 with an outer housing shown in phantom, illustrating various flow paths defined through the anti-rotation pad assembly.

FIG. 4 is a partial perspective view of the anti-rotation pad assembly 102 with the outer housing 106 shown in phantom to illustrate various flow paths defined through the anti-rotation pad assembly 102. The central flow port 104*b* is arranged on a trajectory intersecting the shoulder 134 of the carriage plate 112, and lateral flow ports 104*a* and 104*c* are arranged on trajectories extending to a channel 140 defined in the interior cavity 108 between the carriage plate 112 and the wear plates 114. The channel 140 is disposed radially inwardly of the extensible members 110 and permits fluid flow between the respective lateral flow ports 104*a*, 104*c* on the trailing and leading ends of the anti-rotation pad assembly 102. Fluid flow past the extensible members 110 within the interior cavity 108 may discourage depositing of sediments from mud 36 (FIG. 1) on the extensible members, which may facilitate rotation of the extensible members 110. As indicated below, the carriage plate 112 is arranged to permit fluid flow between the channels 140 and the central flow ports 104*b* as well.

Figure 5:
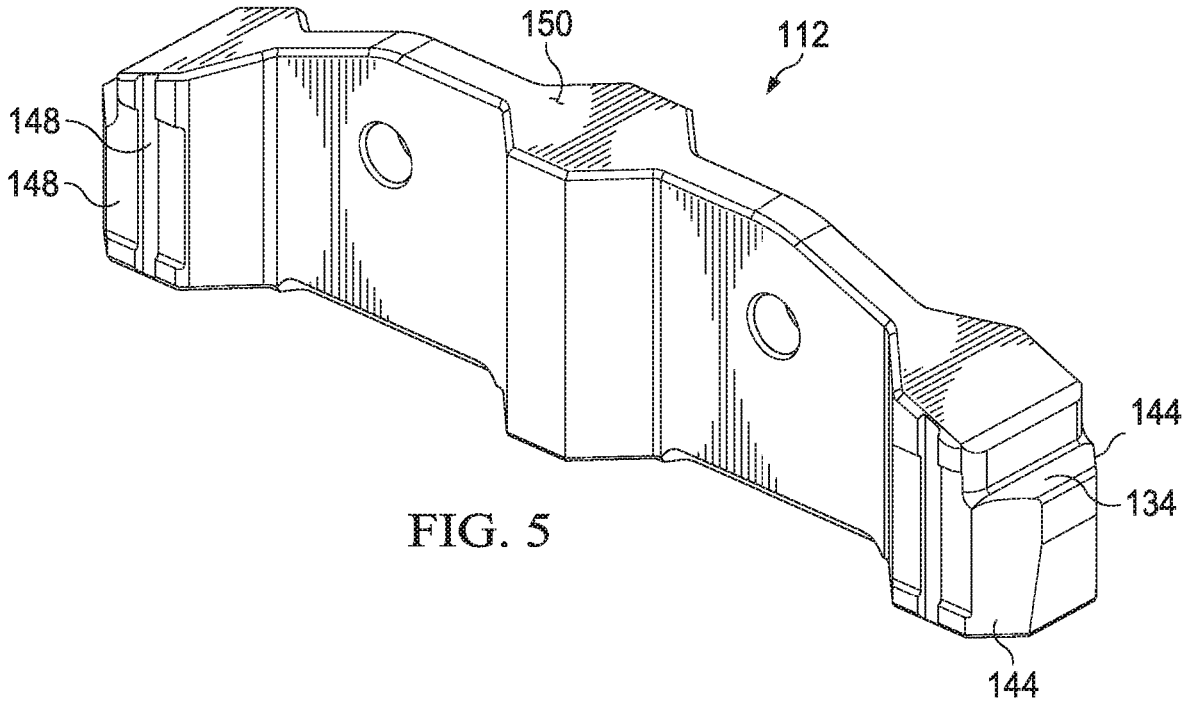
FIG. 5 is a perspective view of the carriage plate of FIG. 2 illustrating chamfered corners and flow passageways milled therein.

FIG. 5 is a perspective view of the carriage plate 112 illustrating chamfered corners 144 and flow passageways 148 milled in an outer surface of the carriage plate. The chamfered corners 114 intersect the shoulder 134 and facilitate fluid flow between the central flow port 104*b* and channels 140 (FIG. 4). The flow passageways 148 extend radially to a radially outer surface 150 of the carriage plate 112. Since the radially outer surface 150 extends out of the interior cavity 108 (FIG. 4), the flow passageways 148 permit fluid flow out of the interior cavity 108 between the carriage plate 112 and the outer housing 106.

Figure 6:
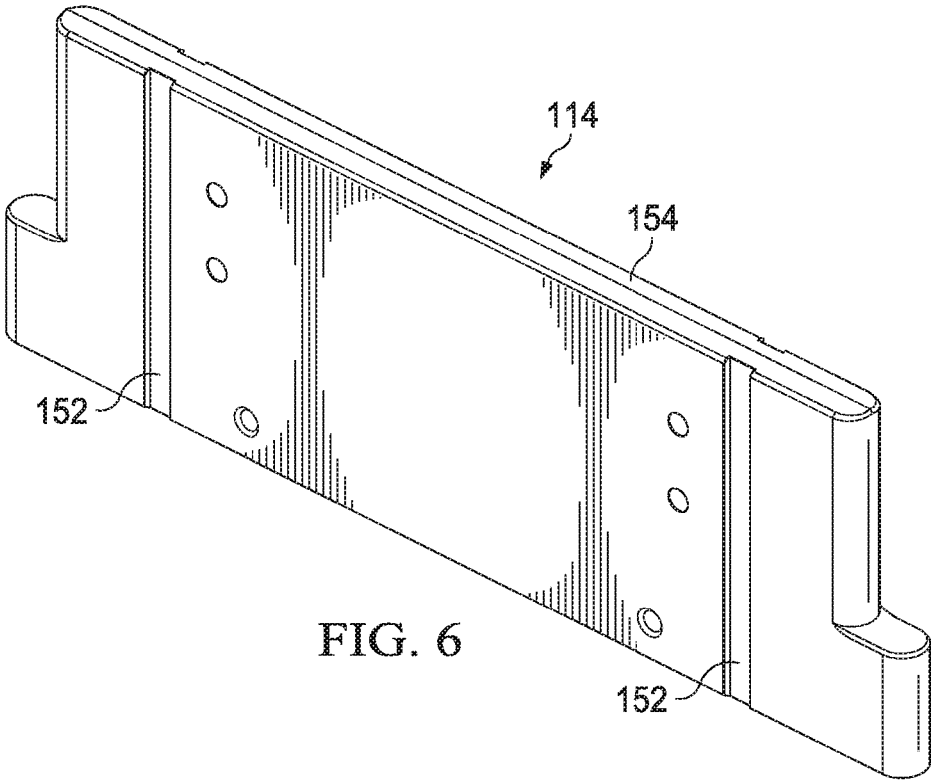
FIG. 6 is a perspective view of a wear plate of FIG. 2 illustrating flow passages milled therein.

FIG. 6 is perspective view of a wear plate 114 illustrating flow passageways 152 milled therein. Similar to the flow passageways 148 (FIG. 5) of the carriage plate 112, the flow passageways 152 extend radially to a radially outermost surface 154 of the wear plate, and therefore may encourage fluid flow out of the interior cavity 108.

Figure 7:
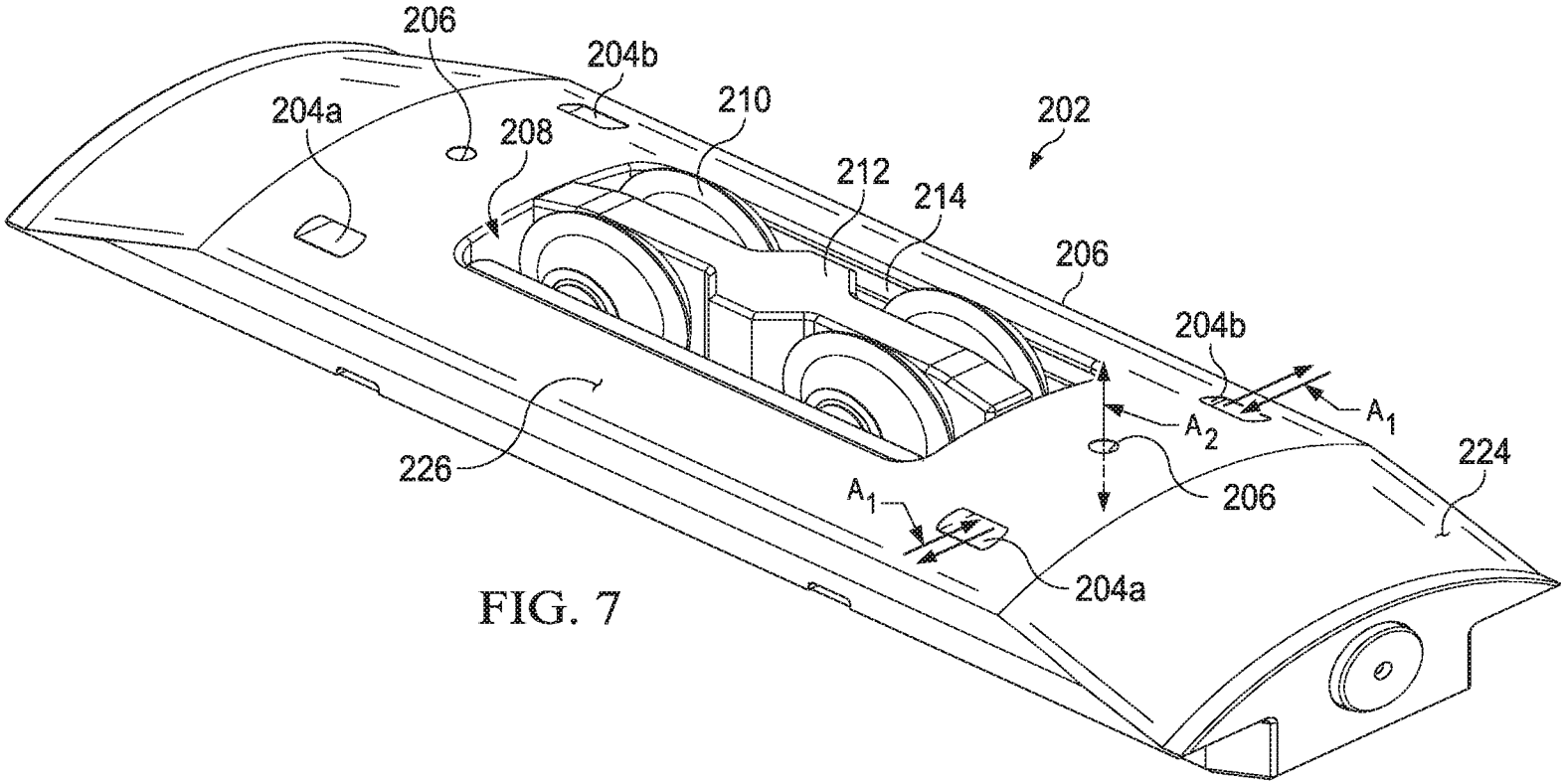
FIG. 7 is a perspective view of an alternate embodiment of an anti-rotation pad assembly illustrating flow ports and fluid removal holes defined therein.

FIG. 7 is a perspective view of an alternate embodiment of an anti-rotation pad assembly 202 illustrating flow ports 204*a*, 204*b* and fluid removal holes 206 defined therein. The anti-rotation pad assembly 202 includes an outer housing 206 defining an interior cavity 208 therein. Disposed within the interior cavity are extensible members 210, a carriage plate 212 and wear plates 214. The extensible members 210, carriage plate 212 and wear plates 214 may operate substantially similarly to the extensible members 110, carriage plate 112 and wear plates 114 (FIG. 2) described above. The flow ports 204*a*, 204*b*, and fluid removal hole 206 differ from flow ports 104 (FIG. 2) described above in that the flow ports 204*a*, 204*b*, and fluid removal hole 206 are not defined in an inclined surface 224 of the outer housing 206, but rather the radially outermost surface 226 of the outer housing 206. The flow ports 204*a*, 204*b* may encourage circumferential flow through the internal cavity 208 (e.g., in the direction of arrows $A_1$) while the fluid removal hole 206 may encourage radial flow in and/or out of the internal cavity 208 (e.g., in the direction of arrows $A_2$).

Figure 8:
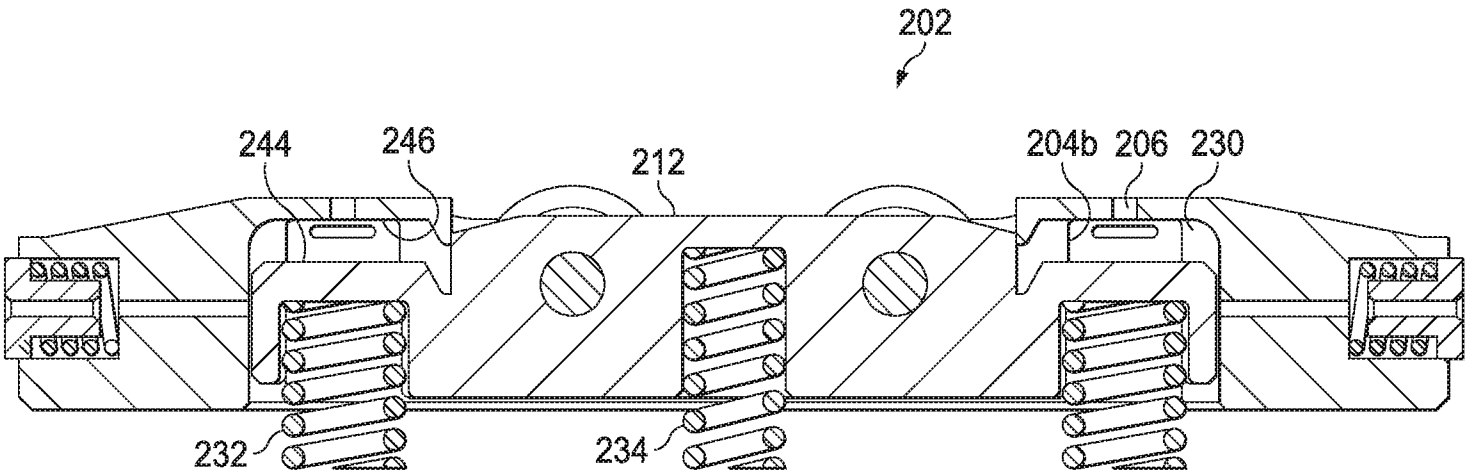
FIG. 8 is a cross-sectional side view of the anti-rotation pad assembly of FIG. 7 illustrating a relatively sealed chamber defined within an internal cavity of the anti-rotation pad assembly, the fluid removal holes in fluid communication with the relatively sealed chamber.

FIG. 8 is a cross-sectional side view of the anti-rotation pad assembly 202 illustrating a relatively sealed chamber 230 defined within the internal cavity 208. Biasing mechanisms 232, 234 are provided to bias the carriage plate 212 radially outward such that a radially outward facing shoulder 244 of the carriage plate 212 is urged toward a radially inward facing shoulder 246 of the outer housing 206. Movement of the carriage plate 212 in the radially outward direction under the influence of biasing mechanisms 232, 234 may increase the fluid pressure within the relatively sealed chamber 230, and thereby encourage fluid flow out of the interior cavity 208 through the flow ports 204*a*, 204*b*, and fluid removal hole 206.

Figure 9:
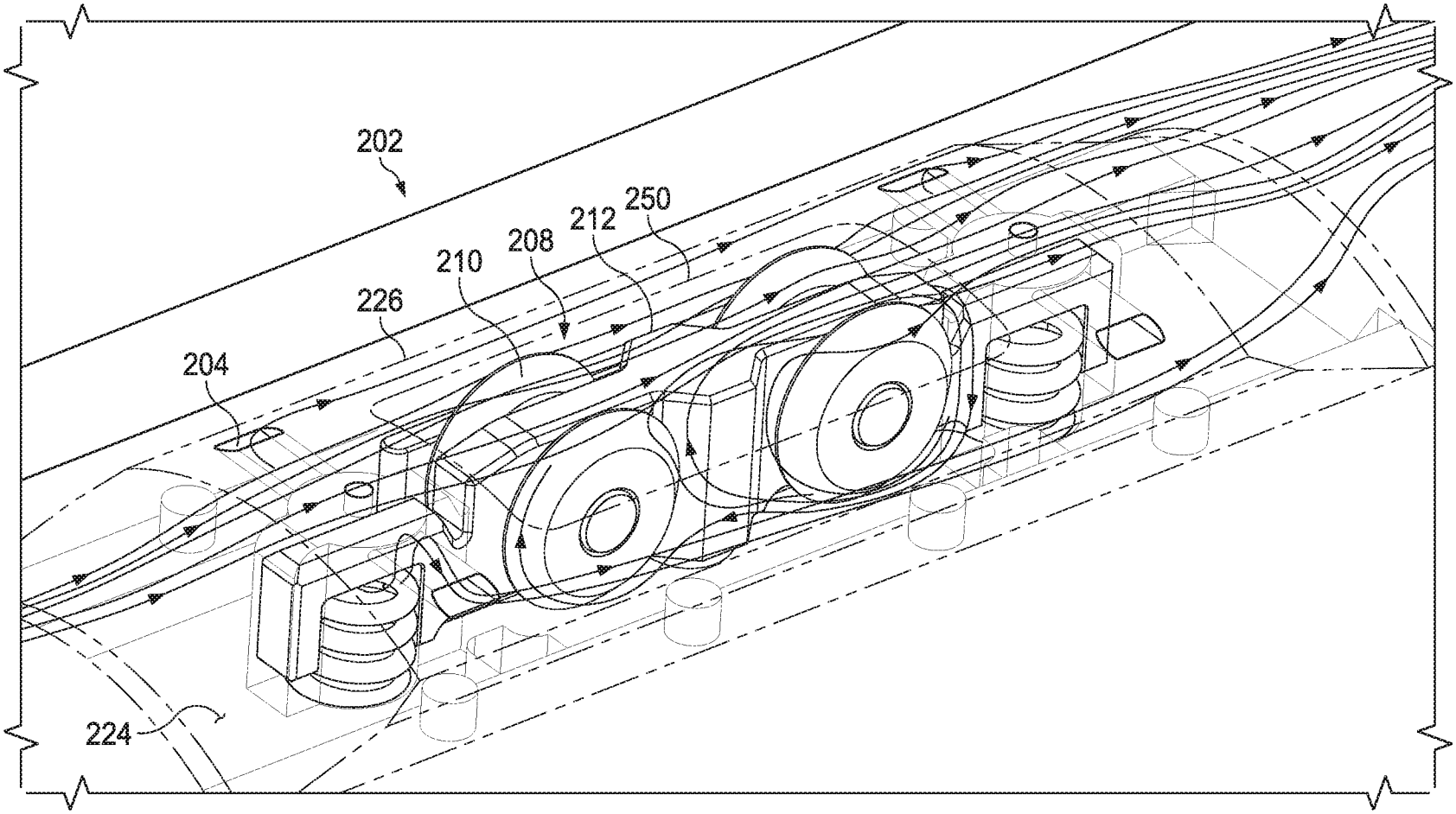
FIG. 9 is a perspective view of the anti-rotation pad assembly of FIG. 7 illustrating a flow model for drilling fluids passing therethrough.

FIG. 9 is a perspective view of the anti-rotation pad assembly 202 illustrating a flow model for drilling fluids passing therethrough. As fluid approaches the anti-rotation pad assembly 202, the fluid encounters inclined surface 224 at the leading end of the anti-rotation pad assembly 202. Fluid may enter the interior cavity 208 through an opening 250 defined in the radially outermost surface 226, and may exit the interior cavity 208 circumferentially through the flow ports 204. The fluid flow through the interior chamber may be sufficient to discourage the depositing of sediments within the interior cavity 208 that could otherwise inhibit movement of the extensible members 210 and carriage plate 212.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to an anti-rotation pad assembly for restraining rotation of a non-rotating housing in a drill string. The anti-rotation pad assembly includes an outer housing defining a primary opening in a radially outermost surface thereof and interior cavity therein. At least one extensible member is radially movable within the interior cavity and movable to a fully extended position protruding radially through the primary opening. At least one flow port is defined in the outer housing. The flow port extending between the interior cavity and a flow port opening in an exterior surface of the outer housing spaced from the primary opening.

In some embodiments, the flow port opening is defined on an inclined surface at a leading end of the outer housing. The inclined surface may extend longitudinally from the radially outermost surface. The assembly may further include a corresponding flow port opening defined on an inclined surface at a trailing end of the outer housing. The at least one flow port may be arranged along a trajectory extending in one of a longitudinal and circumferential direction through the outer housing.

The assembly may further include a carriage plate disposed within the interior cavity for supporting the at least one extensible member thereon. The carriage plate may include a radially outward facing shoulder thereon for engaging a radially inward facing shoulder of the outer housing to retain the carriage plate in the interior cavity. The at least one flow port may be arranged on a trajectory intersecting the radially outward facing shoulder.

In one or more example embodiments, the at least one extensible member is a roller rotationally mounted on the carriage plate about a roller axis substantially normal to a longitudinal axis of the anti-rotation pad assembly. The at least one extensible member may include a plurality of rollers arranged about longitudinally spaced roller axes. The at least one flow port may be arranged on a trajectory intersecting a channel in the interior cavity disposed radially inwardly of the roller. In some embodiments, the carriage plate may include a chamfered corner intersecting the radially outwardly facing shoulder, the chamfered corner providing fluid communication between the radially outward facing shoulder and the channel in the interior cavity.

In some embodiments, the carriage plate includes a flow passageway extending radially along a lateral surface thereof to a radially outermost surface thereof. The assembly may further include a biasing mechanism urging the carriage plate radially outward.

The at least one flow port comprises a fluid removal hole extending radially through the radially outermost surface of the outer housing. The fluid removal hole extends to a relatively sealed chamber defined within the interior cavity, radially between the carriage plate and the outer housing. The assembly may further include at least one flow port extending circumferentially from the relatively sealed chamber.

In another aspect, a non-rotating housing for use in a drill string, includes a tubular member defining a longitudinal axis extending therethrough, at least one outer housing extending radially from the tubular member, the outer housing defining a primary opening in a radially outermost surface thereof and interior cavity therein, at least one extensible member radially movable within the interior cavity and movable to a fully extended position protruding radially through the primary, opening, and at least one flow port defined in the outer housing, the flow port extending between the interior cavity and a flow port opening in an exterior surface of the outer housing spaced from the primary opening.

In some embodiments, the non-rotating housing includes at least three outer housings circumferentially spaced about the tubular member. Each of the at least three outer housings may be equally spaced about the non-rotating housing, and may include an extensible member protruding through a primary opening defined in a radially outermost surface thereof. The flow port opening may be defined on an inclined surface at a leading end of the at least one outer housing, and the inclined surface may extend longitudinally and radially between the radially outermost surface and the tubular member.

In one or more exemplary embodiments, the non-rotating housing may further include an inclination sensor disposed therein. The non-rotating housing and the inclination sensor may both be included in a rotary steerable system, and in some embodiments, the non-rotating housing may be included in a drill string with a drill bit operable to rotate with respect to the non-rotating housing.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. An anti-rotation pad assembly for restraining rotation of a non-rotating housing; in a drill string, the anti-rotation pad assembly comprising:

an outer housing defining a primary opening in a radially outermost surface thereof and interior cavity therein;

at least one extensible member radially movable within the interior cavity and movable to a fully extended position protruding radially through the primary opening; and at least one flow port defined in the outer housing, the at least one flow port extending along a longitudinal trajectory between the interior cavity and a flow port opening in an exterior surface of the outer housing spaced from the primary opening, wherein the flow port opening is defined at a longitudinally-facing, leading end of the outer housing.

2. The assembly according to claim 1, wherein the flow port opening is defined on an inclined surface extending longitudinally from the radially outermost surface.

3. The assembly according to claim 2, further comprising a corresponding flow port opening defined on an inclined surface at a trailing end of the outer housing.

4. The assembly according to claim 1, further comprising a carriage plate disposed within the interior cavity for supporting the at least one extensible member thereon, the carriage plate including a radially outward facing shoulder thereon for engaging a radially inward facing shoulder of the outer housing to retain the carriage plate in the interior cavity, and wherein the at least one flow port is arranged on a trajectory intersecting the radially outward facing shoulder.

5. The assembly according to claim 4, wherein the at least one extensible member is a roller rotationally mounted on the carriage plate about a roller axis substantially normal to a longitudinal axis of the anti-rotation pad assembly.

6. The assembly according to claim 5, wherein the at least one extensible member includes a plurality of rollers arranged about longitudinally spaced roller axes.

7. The assembly according to claim 5, wherein the at least one flow port is arranged on a trajectory intersecting a channel in the interior cavity disposed radially inwardly of the roller.

8. The assembly according to claim 7, wherein the carriage plate includes a chamfered corner intersecting the radially outwardly facing shoulder, the chamfered corner providing fluid communication between the radially outward facing shoulder and the channel in the interior cavity.

9. The assembly according to claim 4, wherein the carriage plate includes a flow passageway extending radially along a lateral surface thereof to a radially outermost surface thereof.

10. The assembly according to claim 4, further comprising a biasing mechanism urging the carriage plate radially outward.

11. The assembly according to claim 4, wherein the at least one flow port comprises a fluid removal hole extending radially through the radially outermost surface of the outer housing, the fluid removal hole extending to a relatively sealed chamber defined within the interior cavity radially between the carriage plate and the outer housing.

12. The assembly according to claim 11, further comprising at least one flow port extending circumferentially from the relatively sealed chamber.

13. A non-rotating housing for use in a drill string, the non-rotating housing comprising:

a tubular member defining a longitudinal axis extending there through;

at least one outer housing extending radially from the tubular member; the outer housing defining a primary opening in a radially outermost surface thereof and interior cavity therein;

at least one extensible member radially movable within the interior cavity and movable to a fully extended position protruding radially through the primary opening; and at least one flow port defined in the outer housing, the flow port extending between the interior cavity and a flow port opening in an exterior surface of the outer housing spaced from the primary opening, wherein the flow port opening is defined on a longitudinally-facing, leading end surface of the at least one outer housing, the longitudinally leading end surface extending radially between the radially outermost surface and the tubular member.

14. The non-rotating housing according to claim 13, wherein the at least one outer housing includes at least three outer housings circumferentially spaced about the tubular member; and wherein each of the at least three outer housings include an extensible member protruding through a primary opening defined in a radially outermost surface thereof.

15. The non-rotating housing according to claim 13, wherein the longitudinally-facing, leading end surface is an inclined surface at a leading end of the at least one outer housing, the inclined surface extending longitudinally and radially between the radially outermost surface and the tubular member.

16. The non-rotating housing according to claim 13, further comprising an inclination sensor disposed therein.

17. A drill string, comprising the non-rotating housing of according to claim 13 and drill bit operable to rotate with respect to the non-rotating housing.

18. A rotary steerable system, comprising the non-rotating housing according to claim 13.

19. An anti-rotation pad assembly for restraining rotation of a non-rotating housing in a drill string, the anti-rotation pad assembly comprising:

an outer housing defining a primary opening in a radially outermost surface thereof and interior cavity therein;

at least one extensible member radially movable within the interior cavity and movable to a fully extended position protruding radially through the primary opening;

a carriage plate disposed within the interior cavity for supporting the at least one extensible member thereon, the carriage plate including a radially outward facing shoulder thereon for engaging a radially inward facing shoulder of the outer housing to retain the carriage plate in the interior cavity; and at least one flow port defined in the outer housing, the at least one flow port extending between the interior cavity and a flow port opening in an exterior surface of the outer housing spaced from the primary opening, and wherein the at least one flow port is arranged on a trajectory intersecting the radially outward facing shoulder.

20. The assembly according to claim 19, wherein the flow port opening is defined on the radially outermost surface spaced from the primary opening.

* * * * *